US009732958B2

(12) United States Patent
Wiklof

(10) Patent No.: US 9,732,958 B2
(45) Date of Patent: Aug. 15, 2017

(54) ELECTRODYNAMIC CONTROL IN A BURNER SYSTEM

(71) Applicant: CLEARSIGN COMBUSTION CORPORATION, Seattle, WA (US)

(72) Inventor: Christopher A. Wiklof, Everett, WA (US)

(73) Assignee: CLEARSIGN COMBUSTION CORPORATION, Seattle, WA (US)

( * ) Notice: Subject to any disclaimer, the term of this patent is extended or adjusted under 35 U.S.C. 154(b) by 280 days.

(21) Appl. No.: 14/206,919

(22) Filed: Mar. 12, 2014

(65) Prior Publication Data

US 2014/0295360 A1 Oct. 2, 2014
US 2017/0191659 A9 Jul. 6, 2017

Related U.S. Application Data

(63) Continuation-in-part of application No. 12/753,047, filed on Apr. 1, 2010, now Pat. No. 8,851,882.

(60) Provisional application No. 61/806,480, filed on Mar. 29, 2013.

(51) Int. Cl.
*F23N 1/00* (2006.01)
*F23N 5/12* (2006.01)
*F23C 99/00* (2006.01)

(52) U.S. Cl.
CPC ..... *F23N 1/002* (2013.01); *F23C 99/001* (2013.01); *F23N 5/123* (2013.01); *F23N 2029/12* (2013.01)

(58) Field of Classification Search
CPC ... F23N 1/002; F23N 5/00; F23N 1/00; F02C 7/24
USPC ..... 431/12, 253, 75, 78, 79; 60/779, 725
See application file for complete search history.

(56) References Cited

U.S. PATENT DOCUMENTS 2,604,936 A 7/1952 Kaehni et al.
3,416,870 A * 12/1968 Wright ..... F23C 99/001 204/168
5,049,063 A * 9/1991 Kishida ..... F23N 1/022 431/25
5,784,889 A * 7/1998 Joos ..... F23C 99/001 431/114
6,205,765 B1 * 3/2001 Iasillo ..... F02C 7/22 431/114
7,137,808 B2 11/2006 Branston et al.
7,243,496 B2 7/2007 Pavlik et al.
8,851,882 B2 10/2014 Hartwick et al.
8,911,699 B2 12/2014 Colannino et al.
9,267,680 B2 2/2016 Goodson et al.
9,284,886 B2 3/2016 Breidenthal et al.
(Continued)

FOREIGN PATENT DOCUMENTS

EP 0844434 5/1998
WO WO 9601394 * 1/1996 ..... F23C 11/00
(Continued)

*Primary Examiner* — Gregory Huson
*Assistant Examiner* — Nikhil Mashruwala
(74) *Attorney, Agent, or Firm* — Dorsey & Whitney LLP

(57) ABSTRACT

A burner system and a retrofit flame control system for an existing burner system are disclosed. The burner system may include burner components, electrodynamic components, and a data interface. The data interface may receive a command for controlling the burner components and prepare a command for controlling the electrodynamic components at least partially based on the command for controlling the burner components.

15 Claims, 3 Drawing Sheets

(56) References Cited

U.S. PATENT DOCUMENTS

| | | | | |
|---|---|---|---|---|
| 9,289,780 | B2 | 3/2016 | Goodson | |
| 9,366,427 | B2 | 6/2016 | Sonnichsen et al. | |
| 9,371,994 | B2 | 6/2016 | Goodson et al. | |
| 9,377,188 | B2 | 6/2016 | Ruiz et al. | |
| 9,377,189 | B2 | 6/2016 | Ruiz et al. | |
| 9,377,195 | B2 | 6/2016 | Goodson et al. | |
| 9,441,834 | B2 | 9/2016 | Colannino et al. | |
| 9,453,640 | B2 | 9/2016 | Krichtafovitch et al. | |
| 9,469,819 | B2 | 10/2016 | Wiklof | |
| 9,494,317 | B2 | 11/2016 | Krichtafovitch et al. | |
| 9,496,688 | B2 | 11/2016 | Krichtafovitch et al. | |
| 2003/0114977 | A1* | 6/2003 | Emord | G01F 9/001 701/103 |
| 2005/0208442 | A1 | 9/2005 | Heiligers et al. | |
| 2007/0225836 | A1* | 9/2007 | Swanson | G05B 17/02 700/45 |
| 2007/0291552 | A1* | 12/2007 | Khatami | G11C 16/20 365/185.33 |
| 2008/0145802 | A1* | 6/2008 | Hammer | F23N 3/002 431/2 |
| 2011/0203771 | A1 | 8/2011 | Goodson et al. | |
| 2011/0211612 | A1* | 9/2011 | Branecky | F24D 19/1006 374/115 |
| 2012/0317985 | A1* | 12/2012 | Hartwick | F23D 14/84 60/722 |
| 2013/0004902 | A1 | 1/2013 | Goodson et al. | |
| 2013/0071794 | A1 | 3/2013 | Colannino et al. | |
| 2013/0170090 | A1 | 7/2013 | Colannino et al. | |
| 2013/0230810 | A1 | 9/2013 | Goodson et al. | |
| 2013/0260321 | A1 | 10/2013 | Colannino et al. | |
| 2013/0323661 | A1 | 12/2013 | Goodson et al. | |
| 2013/0333279 | A1 | 12/2013 | Osler et al. | |
| 2013/0336352 | A1 | 12/2013 | Colannino et al. | |
| 2014/0038113 | A1* | 2/2014 | Breidenthal | F23N 5/16 431/2 |
| 2014/0051030 | A1 | 2/2014 | Colannino et al. | |
| 2014/0065558 | A1 | 3/2014 | Colannino et al. | |
| 2014/0076212 | A1 | 3/2014 | Goodson et al. | |
| 2014/0080070 | A1 | 3/2014 | Krichtafovitch et al. | |
| 2014/0162195 | A1 | 6/2014 | Lee et al. | |
| 2014/0162197 | A1 | 6/2014 | Krichtafovitch et al. | |
| 2014/0162198 | A1 | 6/2014 | Krichtafovitch et al. | |
| 2014/0170569 | A1 | 6/2014 | Anderson et al. | |
| 2014/0170571 | A1 | 6/2014 | Casasanta, III et al. | |
| 2014/0170575 | A1 | 6/2014 | Krichtafovitch | |
| 2014/0170576 | A1 | 6/2014 | Colannino et al. | |
| 2014/0170577 | A1 | 6/2014 | Colannino et al. | |
| 2014/0196368 | A1 | 7/2014 | Wiklof | |
| 2014/0208758 | A1 | 7/2014 | Breidenthal et al. | |
| 2014/0212820 | A1 | 7/2014 | Colannino et al. | |
| 2014/0216401 | A1 | 8/2014 | Colannino et al. | |
| 2014/0227645 | A1 | 8/2014 | Krichtafovitch et al. | |
| 2014/0227646 | A1 | 8/2014 | Krichtafovitch et al. | |
| 2014/0227649 | A1 | 8/2014 | Krichtafovitch et al. | |
| 2014/0248566 | A1 | 9/2014 | Krichtafovitch et al. | |
| 2014/0255855 | A1 | 9/2014 | Krichtafovitch | |
| 2014/0255856 | A1 | 9/2014 | Colannino et al. | |
| 2014/0272731 | A1 | 9/2014 | Breidenthal et al. | |
| 2014/0287368 | A1 | 9/2014 | Krichtafovitch et al. | |
| 2014/0295094 | A1 | 10/2014 | Casasanta, III | |
| 2014/0335460 | A1 | 11/2014 | Wiklof et al. | |
| 2015/0079524 | A1 | 3/2015 | Colannino et al. | |
| 2015/0104748 | A1 | 4/2015 | Dumas et al. | |
| 2015/0107260 | A1 | 4/2015 | Colannino et al. | |
| 2015/0118629 | A1 | 4/2015 | Colannino et al. | |
| 2015/0121890 | A1 | 5/2015 | Colannino et al. | |
| 2015/0140498 | A1 | 5/2015 | Colannino | |
| 2015/0147704 | A1 | 5/2015 | Krichtafovitch et al. | |
| 2015/0147705 | A1 | 5/2015 | Colannino et al. | |
| 2015/0147706 | A1 | 5/2015 | Krichtafovitch et al. | |
| 2015/0219333 | A1 | 8/2015 | Colannino et al. | |
| 2015/0226424 | A1 | 8/2015 | Breidenthal et al. | |
| 2015/0276211 | A1 | 10/2015 | Colannino et al. | |
| 2015/0338089 | A1 | 11/2015 | Krichtafovitch et al. | |
| 2015/0345780 | A1 | 12/2015 | Krichtafovitch | |
| 2015/0345781 | A1 | 12/2015 | Krichtafovitch et al. | |
| 2015/0362178 | A1 | 12/2015 | Karkow et al. | |
| 2016/0018103 | A1 | 1/2016 | Karkow et al. | |
| 2016/0033125 | A1 | 2/2016 | Krichtafovitch et al. | |
| 2016/0040872 | A1 | 2/2016 | Colannino et al. | |
| 2016/0091200 | A1 | 3/2016 | Colannino et al. | |
| 2016/0138800 | A1 | 5/2016 | Anderson et al. | |
| 2016/0161115 | A1 | 6/2016 | Krichtafovitch et al. | |
| 2016/0215974 | A1 | 7/2016 | Wiklof | |
| 2016/0273763 | A1 | 9/2016 | Colannino et al. | |
| 2016/0273764 | A1 | 9/2016 | Colannino et al. | |
| 2016/0290633 | A1 | 10/2016 | Cherpeske et al. | |
| 2016/0290639 | A1 | 10/2016 | Karkow et al. | |
| 2016/0298836 | A1 | 10/2016 | Colannino et al. | |

FOREIGN PATENT DOCUMENTS

| | | |
|---|---|---|
| WO | WO 2015/017084 | 2/2015 |
| WO | WO 2015/089306 | 6/2015 |
| WO | WO 2015/103436 | 7/2015 |
| WO | WO 2015/123683 | 8/2015 |

* cited by examiner

ELECTRODYNAMIC CONTROL IN A BURNER SYSTEM

CROSS-REFERENCE TO RELATED APPLICATIONS

This application claims priority to U.S. Provisional Patent Application No. 61/806,480 filed on 29 Mar. 2013; which, to the extent not inconsistent with the disclosure herein, is incorporated by reference. The present application also is a continuation-in-part of U.S. Patent Application Ser. No. 12/753,047, entitled "SYSTEM AND APPARATUS FOR APPLYING AN ELECTRIC FIELD TO A COMBUSTION REACTION," filed Apr. 1, 2010 and copending with this application at the time of filing, now U.S. Pat. No. 8,851, 882, issued Oct. 7, 2014.

BACKGROUND

There are many technologies where heat is needed and the heat is often generated by burning fuel in a burner system. The fuel is delivered to the burner system and combustion occurs in a flame area (e.g., at the nozzle), resulting in a flame. In some instances, legacy burner systems may have lower efficiencies than newer burner systems, which may include various improvements over the legacy burner systems. Generally, increasing efficiency of the legacy burner systems may be desirable for any number of reasons, such as to reduce fuel cost, reduce emissions, increase output, etc.

In some instances, replacing a legacy burner system may be cost prohibitive or otherwise undesirable. For example, cost of a new system (even when amortized over its useful lifetime) may outweigh fuel savings. Sometimes, a legacy burner system may be updated or retrofitted to improve its efficiency, reduce emissions, and the like. Accordingly, manufacturers and users of burner systems continue to seek improvements for modifying or retrofitting existing burner systems.

SUMMARY

Embodiments disclosed herein relate to combustion systems, retrofit flame control systems, and methods for controlling a flame in a combustion or burner system. The burner system includes one or more burner components configured to control at least one of supply of fuel to a flame area or fuel mixture for forming the flame in the flame area. The burner system further includes one or more electrodynamic components including one or more electrodes configured to control one or more characteristics of the flame. The burner system additionally includes a data interface configured to receive a first command for controlling the burner components and to prepare a second command for controlling at least one of the one or more electrodynamic components, with the second command being at least partially based on the first command.

In an embodiment, a retrofit flame control system is disclosed. The retrofit flame control system includes one or more electrodynamic components configured for integration with an existing burner system capable of producing a flame. The one or more electrodynamic components include one or more electrodes configured to generate an electric field for controlling one or more characteristics of the flame and one or more chargers configured to charge the flame. The flame control system further includes a data interface configured to receive a first command for controlling the burner components and prepare a second command for controlling the one or more electrodynamic components, with the second command being at least partially based on the first command.

In an embodiment, a method for controlling a flame of a burner system is disclosed. The method includes receiving a first command from a control system, with the first command including information for controlling one or more of a burner or a fuel source. The method further includes preparing a second command at least partially based on the first command, with the second command including information for controlling one or more electrodynamic components that include at least one of one or more electrodes or a charger. The method additionally includes transmitting the second command to the one or more electrodynamic components.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

In the following detailed description, reference is made to the accompanying drawings, which form a part hereof. In the drawings, which are not to scale or to proportion, similar symbols typically identify similar components, unless context dictates otherwise. The illustrative embodiments described in the detailed description, drawings and claims, are not meant to be limiting. Other embodiments may be used and/or and other changes may be made without departing from the spirit or scope of the present disclosure.

DETAILED DESCRIPTION

Figure 1A:
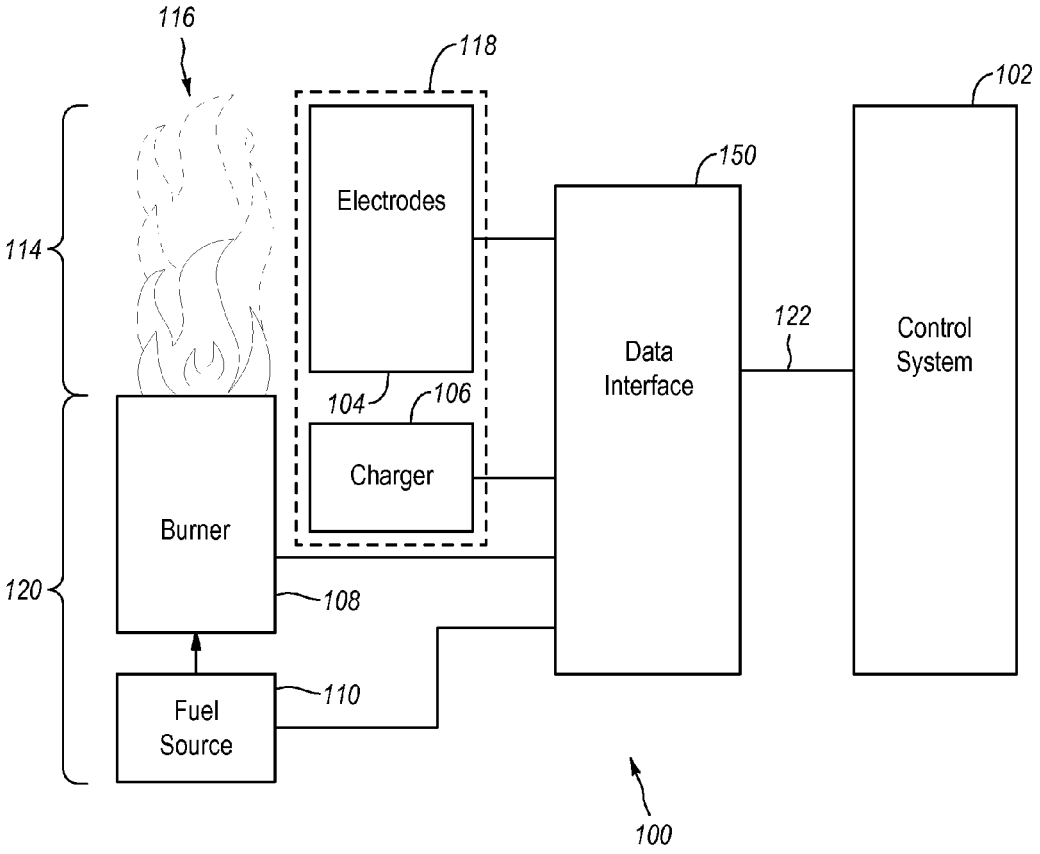
FIG. 1A is a block diagram of a burner system configured to charge a flame and control one or more characteristics of the flame according to an embodiment.

Embodiments disclosed herein relate to combustion systems, retrofit flame control systems, and methods for controlling a flame in a combustion or burner system. Embodiments disclosed herein further relate to a data interface configured to control a burner system. For example, the data interface may be integrated with burner systems including legacy burner systems and that may enable control of the burner system or control of components of the burner system.

In some instances, efficiency of a legacy burner system may be improved by controlling the flame. While the general direction of a flame may be controlled using the flame's momentum, controlling other aspects of the flame (e.g., the flame height) may further improve the efficiency of the legacy burner system. More specifically, in some embodiments, the retrofit flame control system may be easily integrated with an existing burner system to improve efficiency thereof.

An existing burner system may have several components that may be controlled by the retrofit flame control system.

For instance, elements or components of the burner system may be controlled in a manner that impacts the efficiency and operation of the burner system. For example, a burner system typically has a fuel source. The operation of the burner system may be controlled by controlling various aspects or characteristics of the fuel source. Fuel flow rate, mixture ratios, fuel type, fuel temperature, fuel pressure, or the like are examples of characteristics of the fuel or of the fuel source that may be controlled. In some embodiments, the burner may also have controllable elements or components, such as valves and dampeners.

Flame geometry, flame combustion characteristics, flame chemistry, flame heat transfer (e.g., heat transfer to a surface, or non-transfer of heat to a surface), flame holding position, flame luminosity, or combinations thereof may be controlled in accordance with embodiments disclosed herein. A flame generally may include ionized gases or charged particles (ions) with the mix of positive and negative ions. Accordingly, in some instances, the flame has a net zero charge. In some embodiments, as described in more detail below, the flame may be charged to exhibit a net positive or net negative charge so that the charged flame may be manipulated via an electric field.

In at least one embodiment, application of an electric field to one or more regions at least proximate to a flame via one or more electrodes enables influencing flame geometry, flame combustion characteristics, flame chemistry, flame heat transfer (e.g., heat transfer to a surface, non-transfer of heat to a surface), flame holding position, flame luminosity, or combinations thereof. For example, by controlling a timing, a direction, a strength, a location, a wave form, a frequency spectrum of the electric field, or combinations thereof, flame geometry, flame combustion characteristics, flame chemistry, flame heat transfer, flame holding position, flame luminosity, or combinations thereof may be controllably altered.

Flame geometry may be controlled, for example, by charging the flame or the flame area and then using one or more electrodes to apply the electric field to control the flame geometry. Causing a response in the flame via the electric field may include causing a visible response in the flame. Additionally or alternatively, causing a response in the flame via the electric field may include causing increased mixing of fuel and oxidizer in the flame. Causing the increased mixing of fuel and oxidizer may increase a rate of combustion. Additionally or alternatively, causing the increased mixing of fuel and oxidizer may increase fuel and air contact in the flame. Additionally or alternatively, causing the increased mixing of fuel and oxidizer may decrease a flame temperature. Additionally or alternatively, causing the increased mixing of fuel and oxidizer may decrease an evolution of oxides of nitrogen ("NOx") by the flame. Additionally or alternatively, causing the increased mixing of fuel and oxidizer may decrease an evolution of carbon monoxide ("CO") by the flame. Causing the increased mixing of fuel and oxidizer may increase flame stability and/or decrease a chance of flame blow-out. Additionally or alternatively, causing the increased mixing of fuel and oxidizer may increase flame emissivity. Additionally or alternatively, causing the increased mixing of fuel and oxidizer may decrease flame size for a given fuel flow rate.

Embodiments disclosed herein may inject charges (e.g., positive or negative ions) into the flame (or the fuel or the flame area) such that the flame as a whole is electrically biased either positively or negatively (i.e., the flame may have a net negative or net positive charge). By adjusting the electrical bias of the flame, the flame's geometries may also be controlled by applying an appropriate electric field. More specifically, the geometry of the flame may be controlled using one or more electrodes that may have the same charge as the biased flame or a different charge from the biased flame. In some embodiments, the electrodes may be positively charged or negatively charged. Additional or alternative embodiments may include multiple electrodes, some of which may have a negative charge and other may have a positive charge. A counter electrode or ground electrode(s) may also be used to generate the electric fields and to control directions and configurations of the electric fields. The placement and bias of the electrodes may be placed and configured according to a desired flame shape or to enable control of the flame shape according to desired ranges. For example, one or more electrodes may be positioned in or near a buoyancy-dominated region of the flame which may not even be visible as opposed to a momentum-dominated region of the flame that is at or near the base of the flame.

The polarities of the electrodes may be controlled such that the flame is controlled by repulsion or attraction. For example, if the flame is provided with an overall positive charge by the injection or addition of positive ions, then positive electrodes may control the flame geometry or characteristic (e.g., flame height) by repelling the biased flame. More specifically, in an embodiment, positively charged electrodes may repel positive ions in the flame. In this manner, at least the height of the flame may be controlled.

Controlling the flame geometry or other characteristics of the flame may be influenced by placement of the electrodes, size and shape of the electrodes, directions of electric fields, relative potentials of the electrodes or relative strengths of the corresponding electric fields, or the like or any combination thereof. Electrodes may be placed at any number of suitable locations relative to the flame. For example, one or more electrodes may be positioned above the flame, on the sides of the flame, within the flame, or the like or any combination thereof. The electrodes also may have any number of suitable shapes and/or sizes, which may vary from one embodiment to the next, and which may be shaped like rods, rings, partial-rings, plates, or the like or any combination thereof. Also, the electrodes may also be oriented in different directions or along one or more axes. The electrodes for a given burner system may have different shapes, orientations, sizes, or the like. The electrodes in a given burner system may be similarly configured or differently configured.

Embodiments disclosed herein may also contemplate other electrodes. Some other electrodes may be counter electrodes. Counter electrodes (e.g., a grounded electrode) may be included in the burner system (or in a burner configuration) to establish a desired electric field relative to other electrodes that are at a different potential. Other electrodes (e.g., corona electrodes) may be used to generate the ions that are added to or injected into the flame to provide a charge to the flame.

Embodiments disclosed herein further relate to a data interface that may facilitate control of at least the above-described aspects of burner systems. In some embodiments, the data interface may cooperate with multiple controllers using minimal communication lines. In an embodiment, the data interface may be effectively placed between the controllable elements of the burner system and a control system. The data interface may be able to pass data/commands, generate data/commands, route data/commands, the like, or combinations thereof.

In an embodiment, the data interface may include a lookup table ("LUT") stored in a memory. The lookup table may allow or facilitate certain actions to be performed even if not explicitly reflected in the original command. For example, a command to shut off the fuel to the burner may result in commands for other elements of the burner system. In some embodiments, the operational states of the electrodes and the charger may also be changed in response to a command to shut off the fuel to the burner.

The data interface may be configured to receive signals or commands from a control system, interpret the commands, and then route the commands as necessary to implement the original command. Some embodiments may include using the lookup table (e.g., stored in a memory), which may facilitate generating appropriate commands and sending commands to various elements or components of the burner system.

FIG. 1A illustrates an embodiment of a burner system 100 that is configured to control a flame 116. The burner system 100 includes a burner 108 and a fuel source 110. The burner 108 is connected with the fuel source 110. The fuel source 110 may provide pressurized fuel to the burner 108. Pressurizing the fuel may provide direction to the flame and may be used at least in part to control flame height. The fuel provided by the fuel source 110 combusts in the burner 108 (e.g., as the fuel exits nozzles that may be part of the burner 108) and produces the flame 116.

The burner system 100 further includes a control system 102 that is operably connected with electrodes 104, an optional charger 106, the burner 108, and the fuel source 110. In an embodiment, the electrodes 104 and the charger 106 are electrodynamic components 118, while the burner 108 and the fuel source 110 are burner components 120.

The charger 106 is configured to charge the flame 116 or to add charge to the flame 116 (or to a flame area 114). The charger 106 may charge the flame 116 using synchronized AC polarity. The charger 106 may add positive or negative ions (e.g., gaseous ions) to the flame 116, to the fuel flow, or to a flame area to produce a biased flame. As previously discussed, the flame may include ions of different charges, but the overall charge of the flame 116 may be substantially neutral. The charger 106 is configured to provide charge to or bias the flame 116. In some embodiments, the charger 106 may ensure that the overall or net charge of the flame 116 is positive or negative.

In some embodiments, the height of the flame 116 may be controlled using the existing charges in the flame and the charger 106 may not be required. Hence, in at least one embodiment, the charge and potential of the electrodes 104 may be varied and set at least partially based on the response of the flame that has not been charged by the charger 106. In additional or alternative embodiments the charger 106 may be omitted.

The electrodes 104 may be generally arranged relative to the flame 116 and/or to the charger 106 in a manner that the geometry of the flame 116 (e.g., the height) may be controlled. For example, the charger 106 may provide the flame 116 with a positive charge as previously stated. The electrodes 104 may also be positively biased in order to create an electric field that acts on the positively charged flame. By controlling the strength and/or direction of the electric field, the height, width, or other shape of the flame 116 may be adjusted by repelling the flame 116 with the electrodes 104, which act on the charges in the flame 116.

The electrodes 104 also may be turned off, or the potential of the electrodes 104 may be lowered in some embodiments, which would increase the height of the flame 116. In an embodiment, the potential or bias of the electrodes may be made negative, which may increase the height of the flame 116. Various other properties of the flame or related combustion characteristics other than flame geometry may also be controlled by the electric field applied via the electrodes 104 as previously discussed, such as flame combustion characteristics, flame chemistry, flame heat transfer (e.g., heat transfer to a surface, non-transfer of heat to a surface), flame holding position, flame luminosity, or combinations thereof. When controlling the flame, commands issued by the control system 102 may contemplate and account for situations where the polarity of the electrodes 104 is always positive or neutral, always negative or neutral, or where the polarity may change from positive to negative or from negative to positive.

The control system 102 may be configured to control at least the electrodes 104, the charger 106, the burner 108, and the fuel source 110. The control system 102 may control the potential and polarity of the electrodes 104, the amount of charge emitted or generated by the charger 106, the like, or combinations thereof. The control system 102 may also be able to control the burner 108 and the fuel source 110 (e.g., rate of fuel flow, pressure, or the like).

The burner system 100 further includes a data interface 150. The data interface 150 may be integrated in the burner system 100 to interface with the control system 102 and with the electrodynamic components 118 and the burner components 120.

The fuel source 110, for example, may include various components such as valves and dampeners. The control system 102 may issue a command to control the fuel source 110 (e.g., shut or partially close a valve or a dampener). The command may be formed as a set of bits (e.g., a command frame), for example, that may have predefined fields. The commands are received by the data interface 150 and converted into action. Thus, the interface is positioned in the burner system 100 to control the fuel source 110 in response to a command from the control system 102. Similarly, commands directed to the burner (e.g., related to fuel mixing, air flow, or the like) may be converted to action by the data interface 150. The data interface 150 may interpret commands, route commands, augment commands with additional instructions, modify commands, pass commands unmodified, the like, or any combination thereof.

In an embodiment, a communication line 122 may pass commands to the burner components 120 and to the electrodynamic components 118. One or more embodiments may allow incorporation of the electrodynamic components 118 into a legacy burner system without the need of separate control systems. The data interface 150 may generate commands for the electrodynamic components 118, which may be at least partially based on commands by the control system 102 issued to the burner components 120.

For instance, a command to reduce fuel flow may be modified by the data interface 150 to include a command to the electrodes 104 and/or the charger 106 that may be at least partially based on the command issued to the burner components 120. More generally, a command to the burner components 120 typically has a certain effect on the flame 116. The data interface 150 may issue commands to the electrodynamic components 118 that are consistent with such anticipated effect on the flame 116 (from the commands issued to the burner components 120). For example, a command to shut off the fuel flow may result in an additional command to shut off application of voltage to the electrodes 104.

In another example, a command directed to the electrodes 104 (e.g., changing a potential of an electrode, changing a direction or strength of an electric field) or a command directed to the charger 106 (e.g., controlling an amount of injected charge) may be sent on the line 122, which also may be used by the control system 102 for issuing commands to the burner components 120. The data interface 150 enables the same communication line to the control system 102 to be used for all components of the burner system 100 and may prevent commands that would not be understood or accepted by a particular component from reaching that component.

Figure 1B:
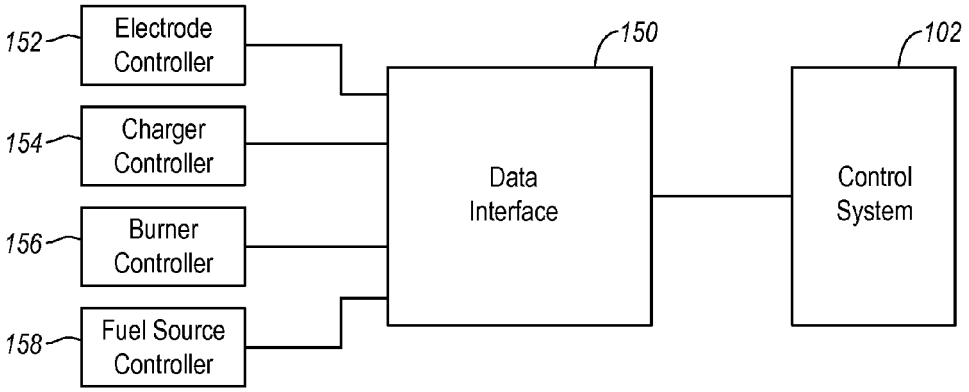
FIG. 1B is a block diagram of an embodiment of a control system in a burner system.

FIG. 1B illustrates a block diagram of an embodiment of a retrofit flame control system that may be integrated with or incorporated into a burner system. For example, in the burner system 100 (FIG. 1A), each of the electrodes 104, the optional charger 106, the burner 108, and the fuel source 110 may each be associated with their own controllers as illustrated in FIG. 1B. For instance, the data interface 150 may have an interface to the control system 102 and an interface to each of an electrode controller 152, a charger controller 154, a burner controller 156, and a fuel source controller 158. Commands from the control system 102 may be interpreted by the data interface 150 and distributed to the appropriate controller (e.g., to the electrode controller 152, charger controller 154, burner controller 156, or fuel source controller 158).

Thus, the data interface 150 may use existing communication line 122 (FIG. 1A) as well as existing communication lines to the burner 108 and the fuel source 110. The data interface 150 may have multiple input and output ("I/O") ports, such that multiple components may be electrically connected one to another in a manner illustrated in FIG. 1A or 1B.

The data interface 150 may include a connection configured to connect to one or more upline components such as the control system 102. The data interface 150 may also include a connection configured to connect to one or more downline components such as component controllers.

The data interface 150 may be embodied as a hardware device and/or as software programmed and/or stored on the hardware control system 102. The data interface 150 receives all data that originates upline. The data interface 150 may then pass data to one or more of the intended components, such as to fuel control components. The data may be reviewed prior to being passed, such that other correlated commands may be generated and sent downline to the electrodynamic control components. In some embodiments, the data interface 150 may have a multi-task operating system that may operate multiple controllers or that may control multiple components.

Figure 2:
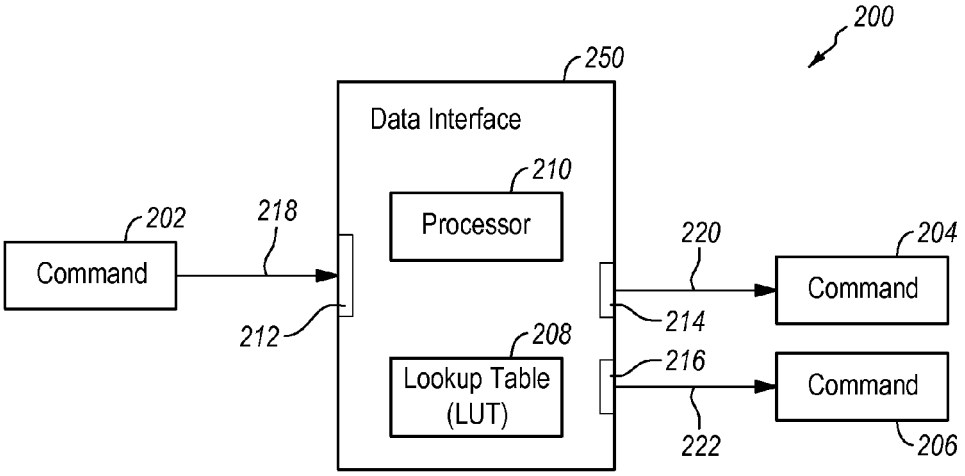
FIG. 2 is a block diagram of an embodiment of a data interface that may be incorporated in a control system to facilitate control of various components of a burner system.

FIG. 2 illustrates an embodiment of a data interface 250 that may be incorporated into a burner system. Except as otherwise described herein, the data interface 250 and a burner system 200 and their respective components or elements may be similar to or the same as the data interface 150 and the burner system 100 (FIG. 1A) and their respective components and elements. In at least one embodiment, the data interface 250 may be integrated with a legacy system and use communication lines that may be already included in the legacy system. The data interface 250 also may facilitate integration or incorporation of additional components, which may be controlled using some of the same communication lines.

The data interface 250 may include a processor 210 and a lookup table (LUT) 208. The LUT 208 may be stored in a memory and may be updated over time. The data interface 250 also may include other circuitry and components that cooperate to receive/transmit data/signals in upline and downline directions. Additionally or alternatively, the data interface 250 may be configured to access the LUT 208, which may be stored and/or located remotely from the data interface 250.

The LUT 208 may be a database or table that stores information related to the control of the burner system 200. For instance, the LUT 208 may include one or more fields that may include information or parameters that may correlate one command with another. Hence, the LUT 208 may be accessed to prepare one or more commands at least partially based on the information contained in one or more other commands. Moreover, the LUT 208 may include specific information for preparing each new command at least partially based on the one or more other commands.

In an embodiment, the LUT 208 may be accessed based on an original command 202 received over a communication line 218 that is connected to a port 212. The LUT 208 may include other commands that correspond to the original command 202. For example, when the command 202 is received by the data interface 250 and processed by the processor 210, the LUT 208 may be accessed to obtain information or parameters from preparing one or more commands that may be based on or related to the original command 202. For instance, commands 204 and 206 may be associated with and/or based on the original command 202. In one or more embodiments, the data interface 250 may generate and/or transmit both the command 204 and the command 206 in response to receiving the command 202.

For instance, the command 202 may be a command to change a pressurization of the fuel source and may be intended for the fuel source 110 or the fuel source controller 158 (FIG. 1A). In an embodiment, the data interface 250 may transmit the command 204 that is similar or identical to the command 202. Furthermore, the data interface 250 may transmit the command 206 to the electrodes. As a result, the data interface 250 may facilitate control of the electrodes 104 in a manner that is consistent with the original command 202, which was intended for the fuel source in this example.

If the change in pressurization was to increase the fuel pressure, then the command 206 to the electrodes may have been made to ensure that the flame height did not change. This enables an increase in heat without changing the flame height. Other commands may be similarly implemented.

The contents of the LUT 208 may be changed as necessary or suitable. For instance, new data may be entered into the LUT 208. The LUT 208 may be configured such that the appropriate actions are taken in response to an initial command (e.g., a command that may be provided by a user). This advantageously relieves the user of having to control each component of the burner system 200 individually. In addition, the control of the burner system 200 may be more consistent or predictable.

The command 202 may have a format that may be interpreted by the data interface 250. The command 202, for example, may identify the component to control, the specific burner affected, a value to implement, a time stamp, other information, or combination thereof. In any event, the data interface 250 may receive the command 202 and may, at least partially based on the LUT 208, prepare new commands 204, 206 at least partially based on the command 202. It should be also appreciated that the data interface 250 may receive any number of commands and may prepare and send any number of commands that may be based at least in part on the received commands. Moreover, any of the sent commands may be similar to or the same as the received commands. In other words, the data interface 250 may generate additional commands (e.g., command 206) at least partially based on the information provided in the original command (e.g., command 202).

The LUT 208 enables the data interface 250 to coordinate control of the components in the burner system 200. The LUT 208 allows the data interface 250 to generate and transmit commands to components that may not be included in the original command. The LUT 208 may be arranged in a table format that may be indexed according to all available commands. Associated portions of the table may then identify the commands that may be generated and transmitted based on the command that was received.

For example, commands that affect the fuel or the fuel flow may be correlated with commands to the charger or electrodes that have a corresponding impact on what the original command intended to achieve. A command to shut off the valve may result in the electrodes and charger being turned off. A command to increase fuel flow rate or flow pressure may result in commands that change the magnitude and/or direction of the electric field or of the amount of charge injected into the flame area.

The LUT 208 also may include routing instructions, which may indicate the destination of the command. Hence, in some embodiments, the LUT 208 may be used to determine which component should receive the command 202. For example, the LUT 208 may contain one or more fields that may be identified using information contained in the command 202, and which may include instructions for routing the command 202 to a component and/or to a port of a component.

The data interface 250 may include multiple ports, illustrated as portions 212, 214, and 216. The port 212 is an input port that is connected to the communication line 218. Advantageously, the same line 218 may be used for communicating commands to all components of the burner system 200. The ports 214 and 216 are examples of output ports and are connected to respective lines 220 and 222. The data interface 250 may include more or fewer ports in other embodiments. As a result, the data interface 250 may be scalable and may accommodate as many components as may be necessary or suitable for a particular application or burner system. The data interface 250 also may facilitate control of multiple burner systems.

For a given command 202, the number of commands output may vary and may depend on the information in the LUT 208. In an embodiment, the data interface 250 may simply pass the command 202 directly through the data interface as the command 204. Alternatively, the command 202 may be changed into two commands, illustrated as the command 204 and the command 206. The lines 218, 220, and 222 may support unidirectional or bi-directional communication. This enables, for example, feedback to be received by the data interface 250 from the various components of the burner system 200.

Figure 3:
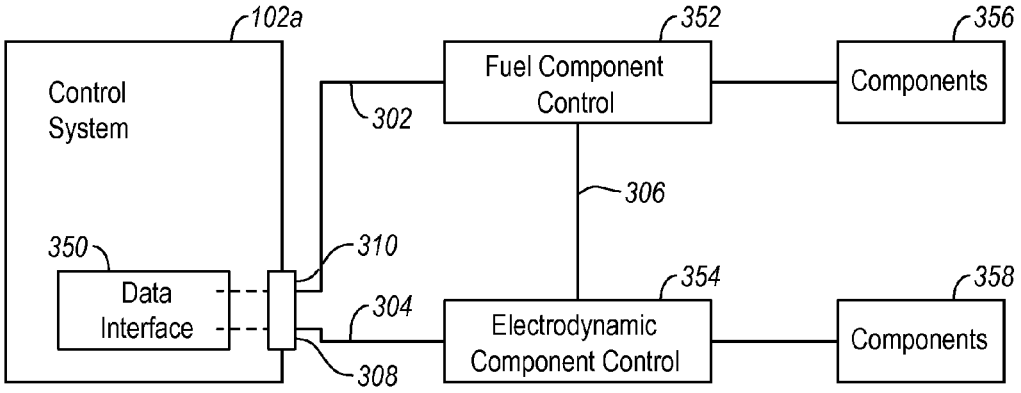
FIG. 3 is a block diagram of a control system for a burner system according to an embodiment.

FIG. 3 illustrates a block diagram of a control system for a burner system according to an embodiment. In FIG. 3, the control system 102*a* includes a data interface 350, which may be implemented as hardware, software, firmware, or combinations thereof. Except as otherwise described herein the control system 102*a* and its elements or components may be similar to or the same as the control system 102 (FIG. 1A) and its respective elements and components. In an embodiment, a single set of wires or communication lines (illustrated as lines 302, 304, and 306) are provided. One, some, or all of the commands to the fuel component control 352 or the electrodynamic component control 354 may be transmitted on the same lines. Each line or link may be unidirectional or bi-directional. In an embodiment, the data interface 350 may be associated with an output port 308 and an input port 310 (they may be the same port in one embodiment). Outgoing communications may proceed on the line 304 to the electrodynamic component control 354, then to the fuel component control 352 on the line 306 and, if necessary, back to the data interface 350 via the line 302.

In an embodiment, commands to the fuel component control 352 may be simply passed through by the electrodynamic component control 354 or vice versa if the commands travel in the other direction. The fuel component control 352 may recognize commands that are intended for the components 356 and cause the appropriate action (e.g., may send such commands to the electrodynamic component control 354). Similarly, the electrodynamic component control 354 may recognize commands that are intended for the components 358 and cause the appropriate action (e.g., may send such commands to the fuel component control 352).

The data interface 350 may have access to a LUT as previously described such that any command generated by the control system 102 may be correlated to the appropriate commands for the components 356 and/or the components 358. In this example, the electrodynamic component control 354 may pass a data stream to the fuel component control 352 while picking out the appropriate commands for the components 358. The fuel component control 352 may similarly pick out the appropriate commands for the components 356. Feedback from the electrodynamic component control 354 may be passed back to the data interface 350 through the fuel component control 352.

The foregoing description illustrates that a single set of wires or lines may be used to convey commands to all components in a burner system and ensure that each component receives the appropriate commands. It should be appreciated that embodiments may include any suitable number of sets of wires, which may vary from one embodiment to the next. Hence, additional or alternative embodiments may include multiple sets of wires, some of which may be dedicated to transmitting data between certain ones of one or more controls and/or one or more components.

Generally, the data interface may be viewed as a wedge data interface that, in an embodiment, may be inserted into legacy systems. The existing communication lines may be used to convey commands while providing a way to control new components that may be added to the system. In addition, the interface may facilitate new components to be properly controlled with legacy commands and/or with commands particular to the new components. For instance, as previously described, the LUT may ensure that commands to a fuel source results in additional commands to the electrodes or charger such that the intended result is achieved by all of the components operating appropriately in the context of the original command.

Figure 4:
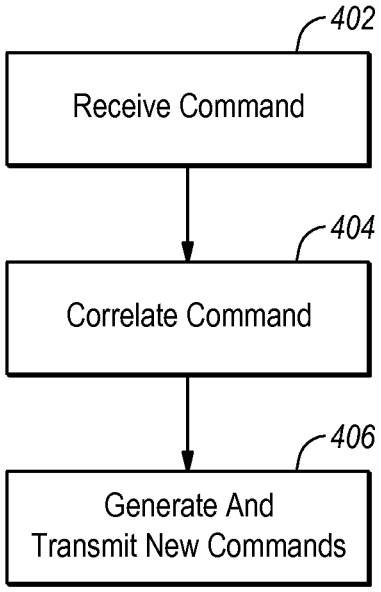
FIG. 4 is an embodiment of a method for controlling a burner system.

FIG. 4 illustrates an embodiment of a method for controlling a burner system. The method may include an act 402 of receiving a command. The command may be received, for example, from a control system or from a user via a user interface (e.g., via a graphical user interface). In an act 404, the data interface may correlate the received command with other commands. The data interface may access memory to identify commands that are correlated with the originally received command. The correlated commands may relate to other components of the burner system that, when performed, may cause the various components to work together to achieve an intent of the original command.

In an act 406, new commands (e.g., commands that correlate with the original command) may be generated. The new commands may include the original command as well as other additional commands. For example, the intent of an original command that is achieved by controlling a fuel source may be implemented with commands to the fuel source and other components that are operated to achieve the same intent as discussed herein. Moreover, in the act 406, the new commands may be transmitted to the appropriate components.

The embodiments disclosed herein, including the control system and/or the data interface, may comprise a special purpose or general-purpose computer including various computer hardware or other hardware including duplexers, amplifiers, or the like, as discussed in greater detail below.

Embodiments disclosed herein also include computer-readable media for carrying or having computer-executable instructions or data structures stored thereon. Such computer-readable media may be any available media that may be accessed by a general purpose or special purpose computer. By way of example, and not limitation, such computer-readable media may comprise RAM, ROM, EEPROM, CD-ROM or other optical disk storage, magnetic disk storage or other magnetic storage devices, or any other medium which may be used to carry or store desired program code means in the form of computer-executable instructions or data structures and which may be accessed by a general purpose or special purpose computer. Combinations of the above should also be included within the scope of computer-readable media.

Computer-executable instructions comprise, for example, instructions and data which cause a general purpose computer, special purpose computer, or special purpose processing device to perform a certain function or group of functions. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

While various aspects and embodiments have been disclosed, other aspects and embodiments may be contemplated. The various aspects and embodiments disclosed here are for purposes of illustration and are not intended to be limiting, with the true scope and spirit being indicated by the following claims.

What is claimed is:

1. A burner system, comprising:

one or more burner components configured to control at least one of supply of fuel to a flame area or fuel mixture for forming the flame in the flame area;

one or more electrodynamic components including one or more electrodes configured to control one or more characteristics of the flame; and a data interface configured to receive a first command for controlling the one or more burner components and to prepare a second command for controlling at least one of the one or more electrodynamic components, the second command being at least partially based on the first command.

2. The burner system of claim 1, wherein the data interface is configured to access a lookup table containing information for preparing the second command at least partially based on the first command.

3. The burner system of claim 2, wherein the lookup table includes a database.

4. The burner system of claim 1, wherein the data interface is configured to send the second command to at least one of the one or more electrodynamic components.

5. The burner system of claim 4, wherein the data interface is configured to send the first command to at least one of the one or more burner components.

6. The burner system of claim 4, wherein the data interface is configured to prepare a third command that is the same as the first command and to send the third command to at least one of the one or more burner components.

7. The burner system of claim 1, wherein the burner components include one or more of a fuel source or a burner.

8. The burner system of claim 1, wherein the first command is received from a control system.

9. The burner system of claim 1, wherein the one or more burner components include a fuel source and the first command is configured to control the fuel source and the second command is configured to control the one or more electrodes.

10. The burner system of claim 1, further comprising a single line for sending commands to the one or more burner components and to the one or more electrodynamic components.

11. The burner system of claim 4, wherein the data interface includes at least one input port and at least one output port, wherein the command to the fuel source is transmitted over a first output port and the command to the one or more electrodynamic control components is transmitted over a second output port.

12. The burner system of claim 1, wherein the one or more electrodes of the one or more electrodynamic components include a charger configured to inject charge into a flame area.

13. The burner system of claim 1, wherein the one or more electrodes are configured to generate an electric field and the one or more characteristics of the flame include a flame geometry.

14. The burner system of claim 13, wherein the flame geometry includes a flame height.

15. The burner system of claim 1, wherein the data interface is configured to perform at least one of route commands received from a control system, pass commands received from the control system, modify commands received from the control system, or generate additional commands at least partially based on received commands.

* * * * *